US010524587B2

(12) United States Patent
Rosner et al.

(10) Patent No.: US 10,524,587 B2
(45) Date of Patent: Jan. 7, 2020

(54) CABINET WITH TELESCOPING TRAYS FOR FASTENER BINS

(71) Applicant: THE HILLMAN GROUP, INC., Cincinnati, OH (US)

(72) Inventors: Brian D. Rosner, Phoenix, AZ (US); James F. Huss, Scottsdale, AZ (US); Nalinikanth Garikapati, Phoenix, AZ (US)

(73) Assignee: THE HILLMAN GROUP, INC., Cincinnati, OH (US)

( * ) Notice: Subject to any disclaimer, the term of this patent is extended or adjusted under 35 U.S.C. 154(b) by 0 days.

(21) Appl. No.: 15/676,260

(22) Filed: Aug. 14, 2017

(65) Prior Publication Data

US 2018/0049562 A1 Feb. 22, 2018

Related U.S. Application Data

(60) Provisional application No. 62/375,985, filed on Aug. 17, 2016.

(51) Int. Cl.

| | |
|---|---|
| ***A47B 88/04*** | (2006.01) |
| ***A47B 57/00*** | (2006.01) |
| ***A47F 3/00*** | (2006.01) |
| ***A47F 3/06*** | (2006.01) |
| ***A47F 5/00*** | (2006.01) |
| ***A47F 7/00*** | (2006.01) |
| *A47B 88/49* | (2017.01) |

(52) U.S. Cl.

CPC ..... *A47F 3/063* (2013.01); *A47F 3/004* (2013.01); *A47F 5/0025* (2013.01); *A47F 7/00* (2013.01); *A47B 88/49* (2017.01)

(58) Field of Classification Search

CPC ..... A47F 3/063; A47F 3/004; A47F 5/0025; A47F 7/00; A47B 67/04; A47B 88/417; A47B 47/042

See application file for complete search history.

(56) References Cited

U.S. PATENT DOCUMENTS 844,338 A * 2/1907 Elett et al. ..... A47B 51/00 312/312
1,244,609 A * 10/1917 Hood et al. ..... A47B 88/0014 312/330.1
1,831,867 A * 11/1931 Jonke ..... A47B 96/025 312/301

(Continued)

OTHER PUBLICATIONS

Admitted prior art, 6 pages.

*Primary Examiner* — Kimberley S Wright
(74) *Attorney, Agent, or Firm* — Thompson Hine LLP

(57) ABSTRACT

A fastener storage and display cabinet includes a housing defining an internal space, with a plurality of tray units positioned within the internal space. Each tray unit is movable between a closed position primarily within the internal space and an extended position in which a majority of the tray unit is cantilevered forward of the housing. At least one tray unit is formed as a telescoping tray assembly comprising an upper tray component and a lower tray component, wherein the upper tray component fits within the lower tray component and is movable with respect to the lower tray component between a first position nested within the lower tray component and a second position cantilevered forwardly from the lower tray component.

9 Claims, 24 Drawing Sheets

(56) References Cited

U.S. PATENT DOCUMENTS 2,238,004 A * 4/1941 Wolters ..... A47B 63/02 312/303
2,904,382 A * 9/1959 Mitten ..... B65D 5/48048 229/120.02
3,013,853 A * 12/1961 Toms ..... A47B 63/02 312/303
3,232,687 A * 2/1966 Mulreed ..... A47B 88/49 312/334.8
4,113,329 A * 9/1978 Thurman ..... B65D 11/14 206/509
4,453,785 A * 6/1984 Smith ..... G11B 23/0236 206/307.1
D274,489 S * 7/1984 DeVries ..... D6/675.1
4,502,741 A * 3/1985 DeVries ..... A47B 47/042 108/102
4,531,645 A * 7/1985 Tisbo ..... A47F 5/02 211/126.15
4,678,245 A * 7/1987 Fouassier ..... G11B 33/04 206/308.1
4,739,887 A * 4/1988 Beach ..... H01H 9/025 211/187
4,909,406 A * 3/1990 Wu ..... A45C 7/00 220/528
5,016,772 A * 5/1991 Wilk ..... B65D 21/086 220/495.01
5,061,021 A * 10/1991 Rodum ..... A47B 63/02 312/231
5,094,516 A * 3/1992 Hunter ..... A47B 88/467 312/319.1
5,097,946 A * 3/1992 Emrich ..... G11B 33/0455 206/308.1
5,137,340 A * 8/1992 Cugley ..... A47B 67/04 312/107
5,183,177 A * 2/1993 Yu ..... G11B 23/0236 206/308.1
5,385,399 A * 1/1995 Weidner ..... A47B 63/00 312/190
5,399,006 A * 3/1995 Murazumi ..... A47B 87/0207 312/109
5,725,105 A * 3/1998 Boland ..... G11B 33/0455 211/40
5,927,839 A 7/1999 Alfaro
5,944,201 A * 8/1999 Babboni ..... A47B 46/00 211/151
5,980,002 A * 11/1999 Crowe ..... A47B 81/068 312/9.28
6,027,186 A * 2/2000 Liou ..... G11B 33/0438 206/308.1
6,042,204 A * 3/2000 Quirch ..... A47B 63/00 312/273
6,086,176 A 7/2000 Aoyama
6,375,235 B1 4/2002 Mehmen
6,637,841 B1 * 10/2003 Dumornay ..... G11B 33/0444 312/9.48
7,082,783 B2 8/2006 Uihlein et al.
7,108,338 B2 9/2006 Katsuyama et al.
7,261,385 B2 8/2007 Weinberger
7,296,433 B2 11/2007 Uihlein et al.
7,380,410 B2 6/2008 Rand et al.
7,464,827 B2 12/2008 Meissen
7,574,758 B2 8/2009 Arason et al.
7,712,852 B2 5/2010 Choi et al.
7,740,331 B2 6/2010 Koo
7,874,176 B2 1/2011 Uihlein et al.
8,616,386 B1 12/2013 Tsai
8,708,435 B2 4/2014 Johnson et al.
8,814,287 B2 8/2014 Jang
8,833,881 B2 9/2014 Manniso et al.
8,857,927 B2 10/2014 Johnson et al.
9,016,811 B2 4/2015 Raunikar
9,103,582 B2 8/2015 Nash et al.
9,167,705 B2 10/2015 Kyle
9,335,089 B1 5/2016 Gossens
2002/0158555 A1 * 10/2002 Wang ..... A47B 67/04 312/263
2004/0124753 A1 7/2004 Stoller et al.
2008/0129167 A1 6/2008 Rand et al.
2008/0202976 A1 * 8/2008 Burgess ..... A47B 88/90 206/558
2010/0162745 A1 * 7/2010 Kim ..... F25D 25/025 62/407
2012/0217858 A1 8/2012 Lai
2016/0146531 A1 5/2016 Gossens
2016/0332165 A1 * 11/2016 Gunther ..... B01L 3/50855

* cited by examiner

CABINET WITH TELESCOPING TRAYS FOR FASTENER BINS

TECHNICAL FIELD

This application relates generally to storage and display of fasteners and, more specifically, to a cabinet with telescoping trays that enable two fastener bins to be contained within each tray.

BACKGROUND

Fasteners are often presented for selection in hardware stores in rectangular fastener bins, where each bin typically has a lid that can be pivoted upward to access the bin interior, and the bin interior typically includes multiple compartments, each compartment holding a particular fastener component (e.g., bolts, nuts, washers etc.). In the past such bins have been supported on trays or shelves that can be pulled outward by a customer. Typically fastener cabinets have utilized trays of single-piece design, where the effective limits for tray withdrawal while still providing support for the fastener bin have limited each tray to holding and supporting a single bin. Product storage space is a premium within most retail environments.

Accordingly, it would be desirable to provide a fastener cabinet and associated tray arrangement that enables a higher density of fastener bin storage.

SUMMARY

In one aspect, a fastener storage and display cabinet includes a housing defining an internal space, with a plurality of tray units positioned within the internal space. Each tray unit is movable between a closed position primarily within the internal space and an extended position in which a majority of the tray unit is cantilevered forward of the housing. At least one tray unit is formed as a telescoping tray assembly comprising an upper tray component and a lower tray component, wherein the upper tray component fits within the lower tray component and is movable with respect to the lower tray component between a first position nested within the lower tray component and a second position cantilevered forwardly from the lower tray component.

The details of one or more embodiments are set forth in the accompanying drawings and the description below. Other features, objects, and advantages will be apparent from the description and drawings, and from the claims.

DETAILED DESCRIPTION

Figure 1:
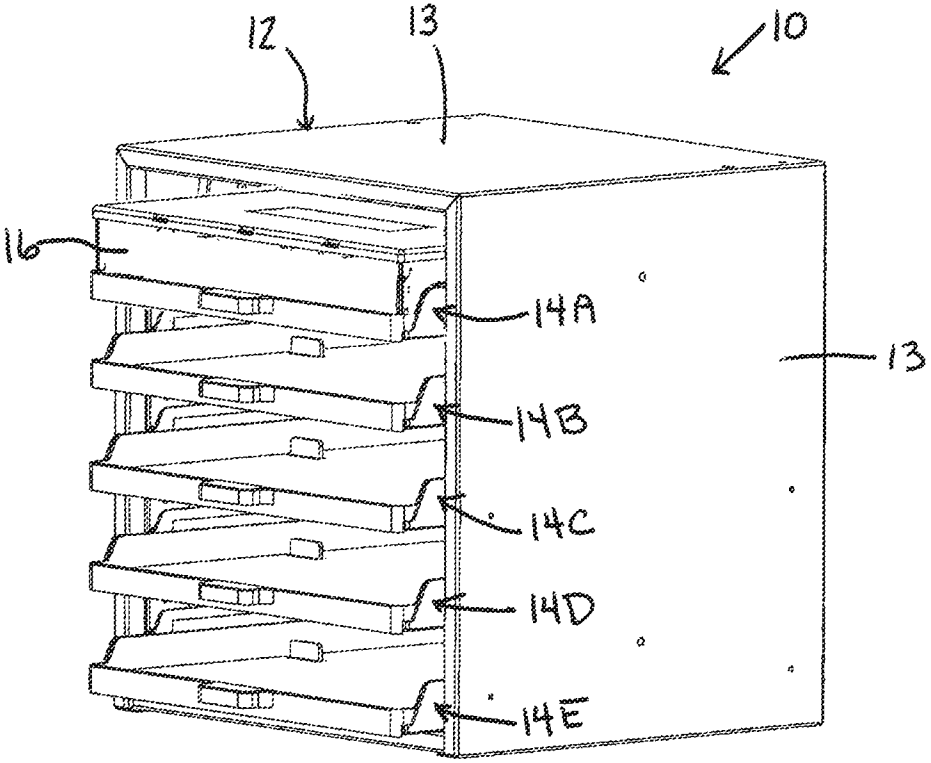
FIG. 1 shows one embodiment of a fastener cabinet.

Referring now to FIGS. 1-16, a fastener storage and display cabinet 10 includes a housing 12 with left, right, top, bottom and rear sidewalls 13 defining an internal space 15, and a front side opening 17 providing access to the internal space. In one example, the housing is of metal construction, but other materials could be used. In the illustrated example the housing has sidewalls that are generally planar and closed, but it is recognized that other housing configurations, such as frame-type housings are possible The housing 12 includes a plurality of tray units 14A-14E mounted within the internal space. Although five tray units are shown in the illustrated embodiment, variations with more or less tray units are possible. Each tray unit is movable between a closed position (e.g., per FIG. 1 where all tray units are in closed positions), where the closed position is primarily within the internal space of the housing, and an extended position (e.g., per FIG. 2 where tray unit 14A is in the extended position) in which a majority of the tray unit is cantilevered forward of the housing.

Figure 2:
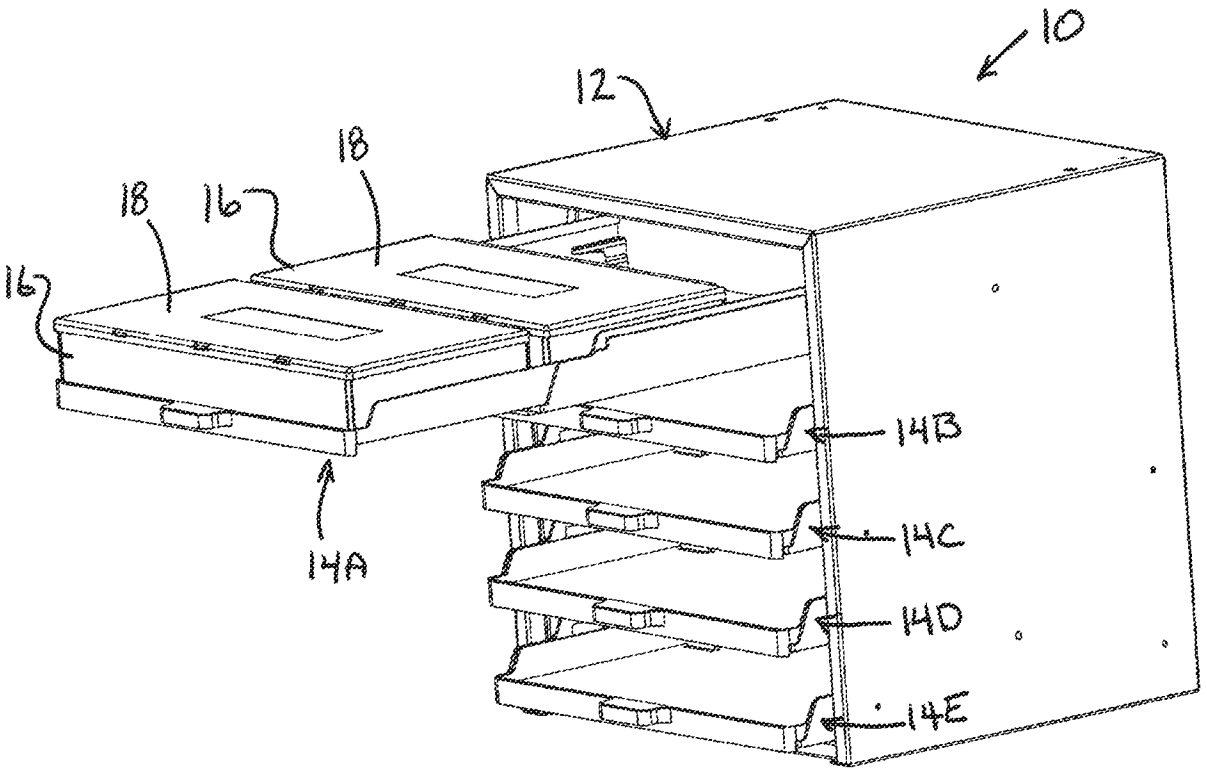
FIGS. 2 and 3 show the fastener cabinet of FIG. 1 with a tray unit in extended position for fastener bin access.
Figure 3:
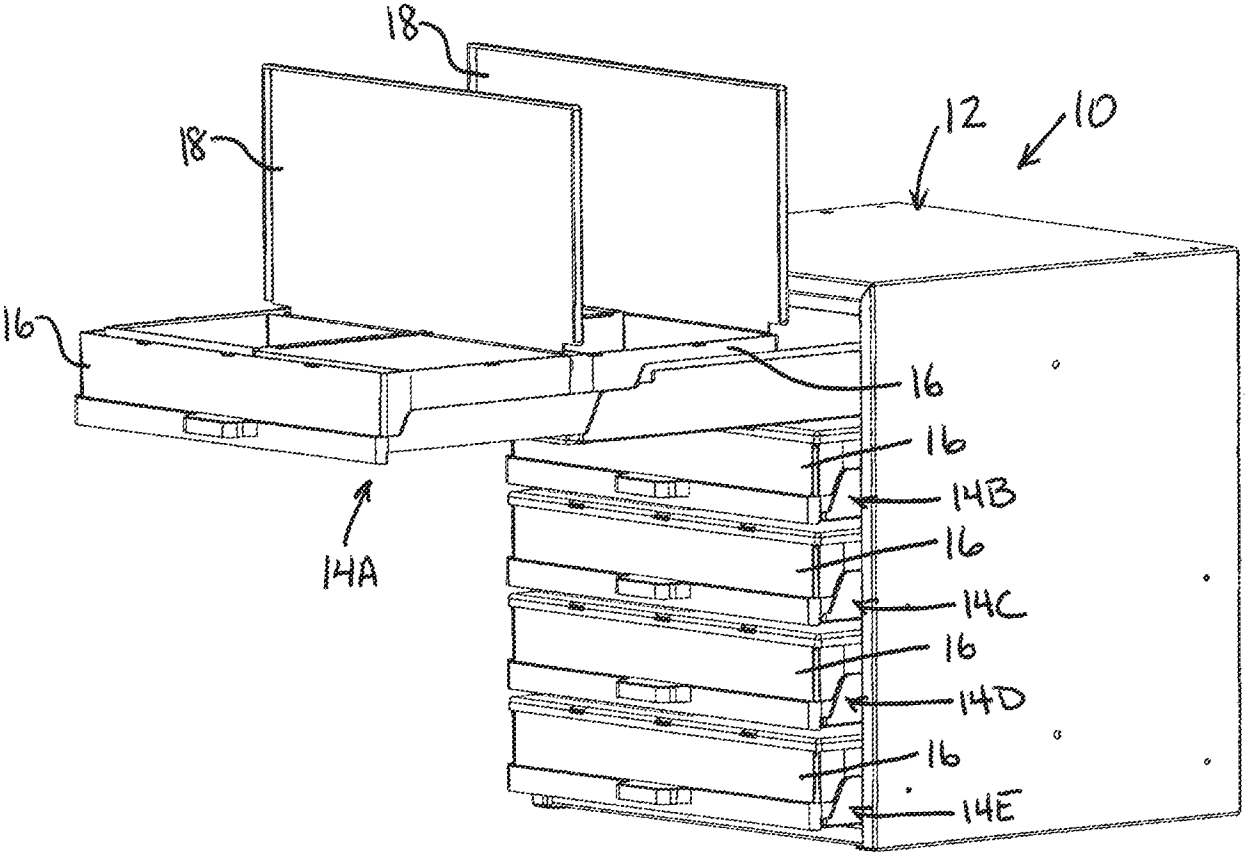

The tray units are sized to support fastener bins 16, where each tray unit is capable of holding two fastener bins as shown in FIG. 2. When a tray unit is in its extended position, both fastener bins 16 are sufficiently accessible and clear of the housing 12 and other tray units to permit the bin lids 18 to be pivoted upward for access to fasteners within the bin (per FIG. 3, where all tray units are shown holding bins). In an alternative configuration the fastener bins 16 could be positioned side-by-side on the tray units.

Figure 4:
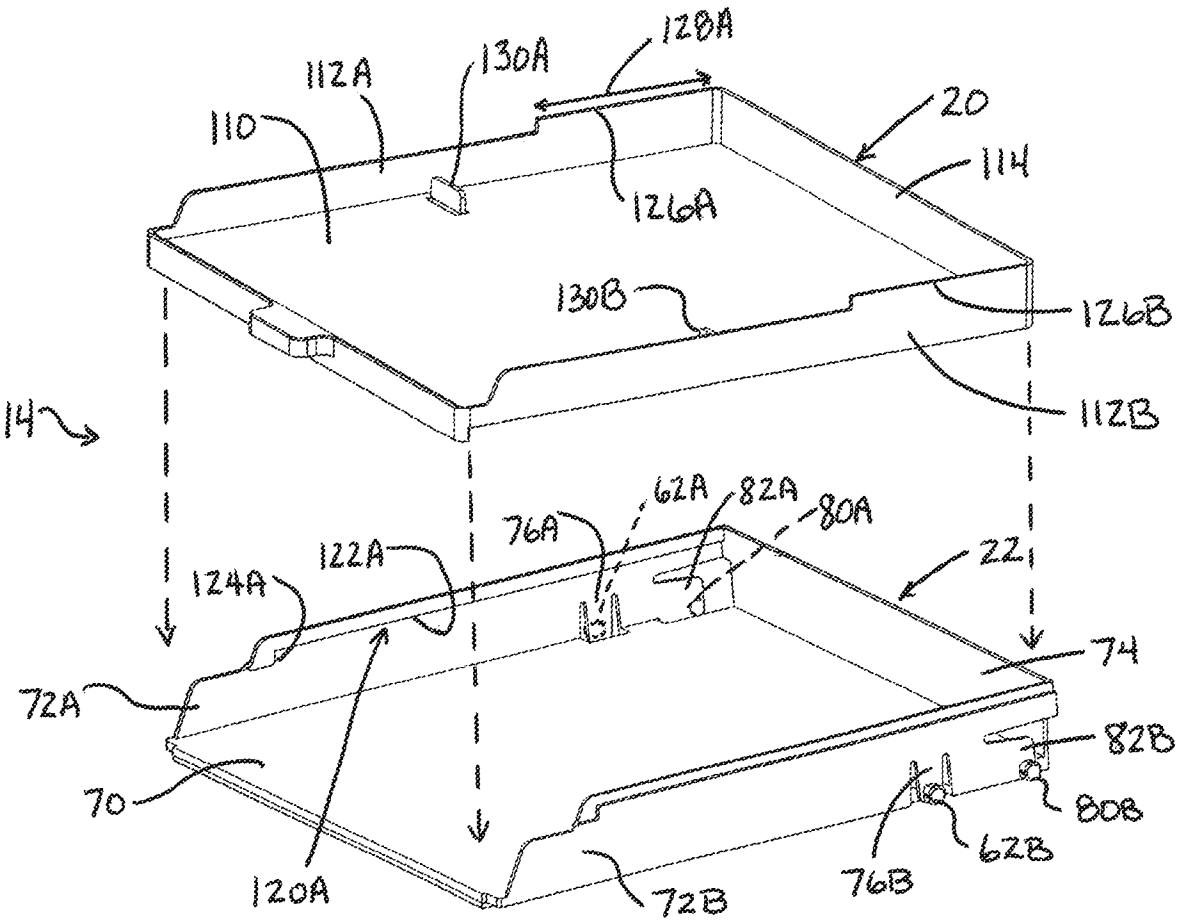
FIG. 4 shows an exploded view of one embodiment of a tray unit assembly.
Figure 5:
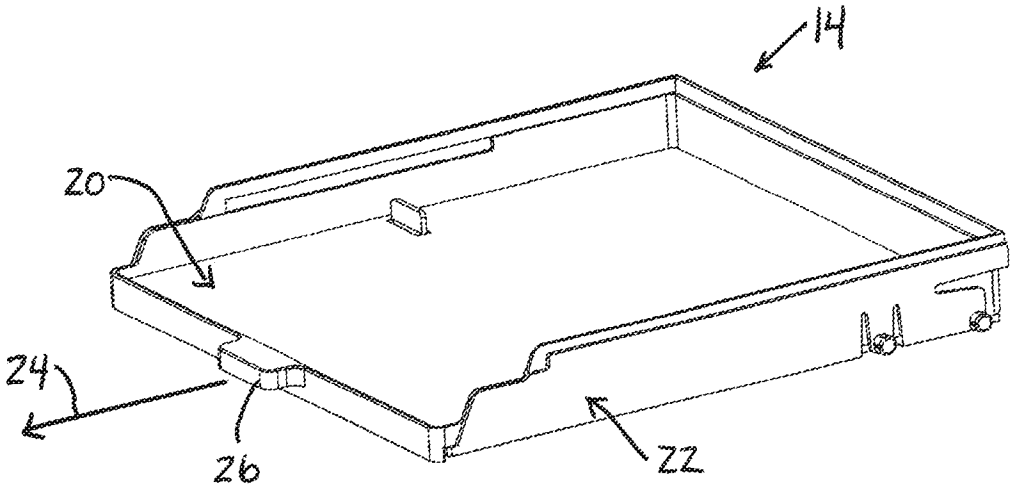
FIG. 5 shows the tray unit in assembled collapsed position.
Figure 6:
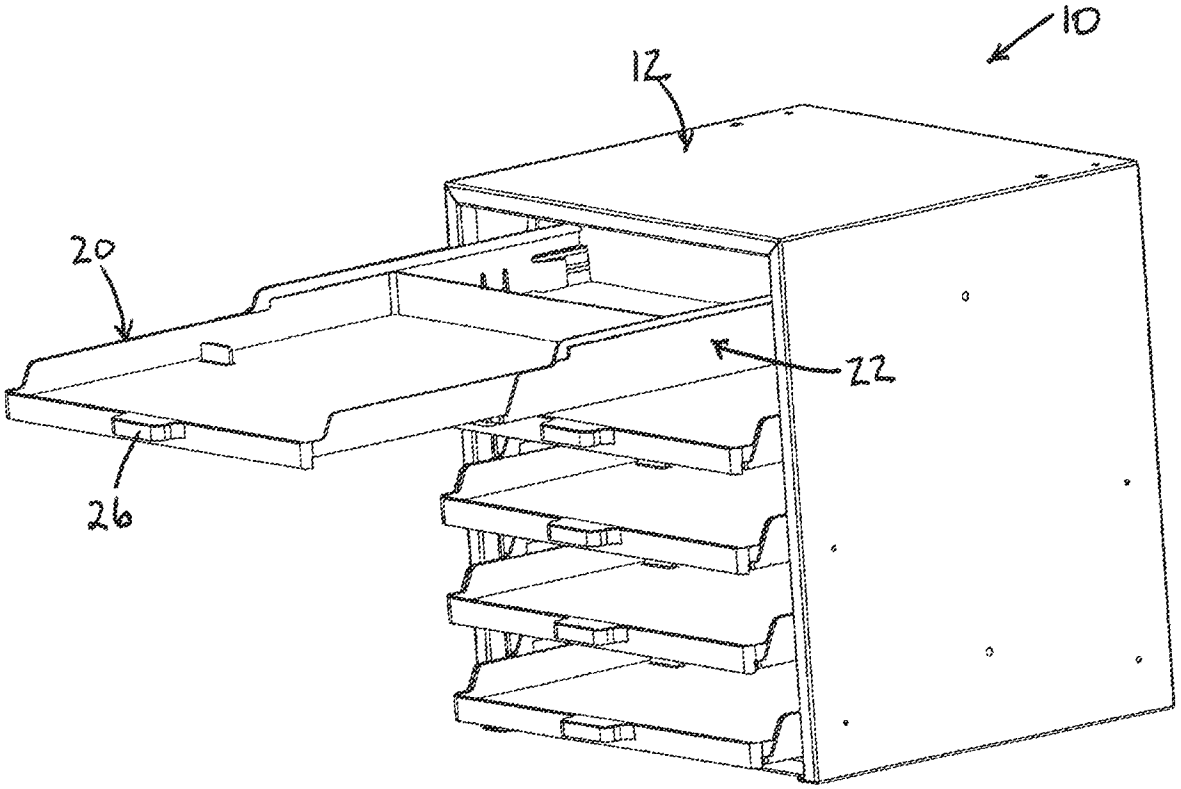
FIG. 6 shows the tray unit in assembled extended position from a cabinet.
Figure 7:
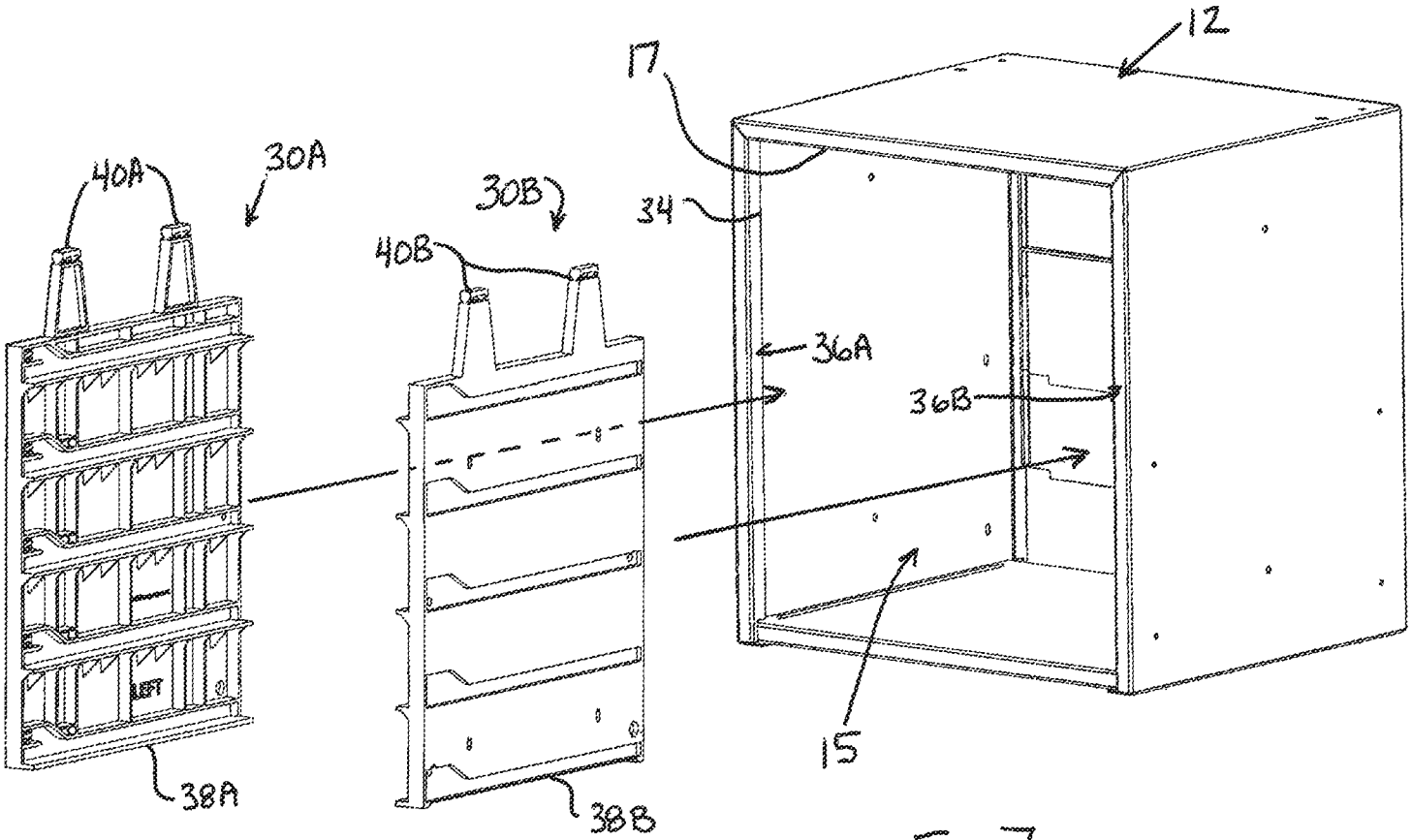
FIG. 7 shows an exploded view of the cabinet housing and track inserts.

As best seen in FIGS. 4-6, each tray unit 14 is formed as a telescoping tray assembly with an upper tray component 20 and a lower tray component 22. The upper tray component 20 fits within the lower tray component 22 and is movable with respect to the lower tray component (per arrow 24 in FIG. 5) between a position nested within the lower tray component (FIG. 5) and a position cantilevered forwardly from the lower tray component (FIG. 6). In one implementation, each tray component may be of a molded plastic material, but variations on material and formation process are possible.

Figure 8:
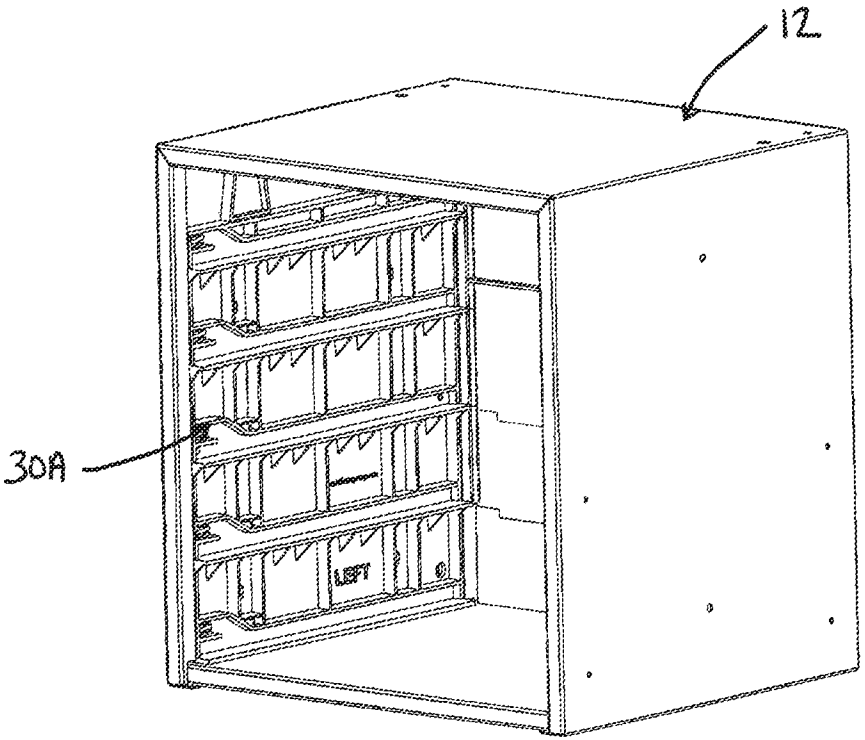
FIG. 8 shows an assembled view of the cabinet housing and track inserts.

When a tray unit is moved into its extended position (e.g., per FIG. 6) as a result of pulling forward on a front handle 26 the upper tray component 20, the lower tray component 22 slides along a track system within the housing 12. In this regard, reference is made to FIG. 7 where a cabinet housing 12 and left and right track inserts 30A and 30B are shown in an exploded view. The track inserts can be loaded in through the housing opening 17, which is defined by a narrow frame 34 having left and right frame segments 36A and 36B that help capture and retain the track inserts 30A and 30B when the track inserts are pressed against the respective left and right sidewalls of the housing. In this regard, a lower base portion 38A, 38B of each track insert and upwardly extending arms 40A, 40B of each insert are sized to abut against the bottom and top walls of the housing to further aid in retaining the inserts in place. FIG. 8 shows the track inserts 30 seated within the housing against the left sidewall. Each track insert may, in one example, be formed of molded plastic, but variations on material and formation process are possible.

Figure 9:
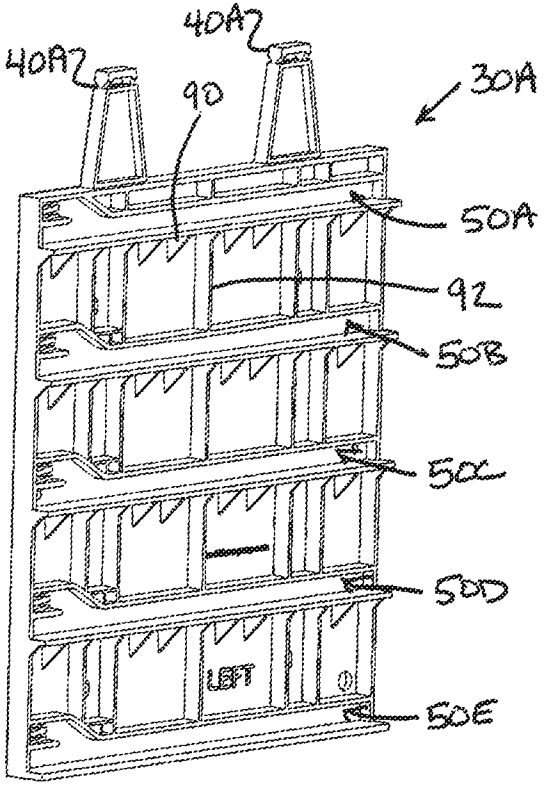
FIGS. 9 and 10 show perspective and side elevation views of one embodiment of a left track insert.
Figure 10:
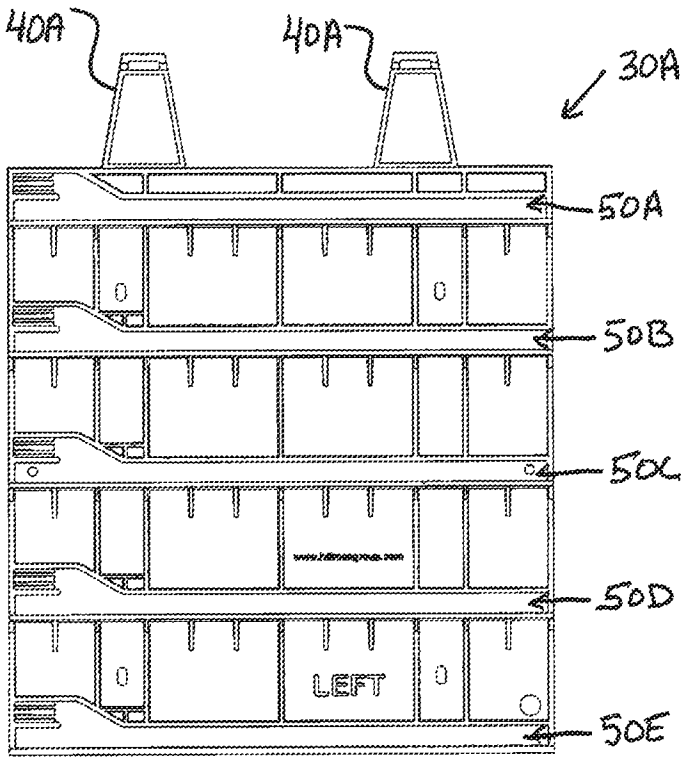
Figure 11:
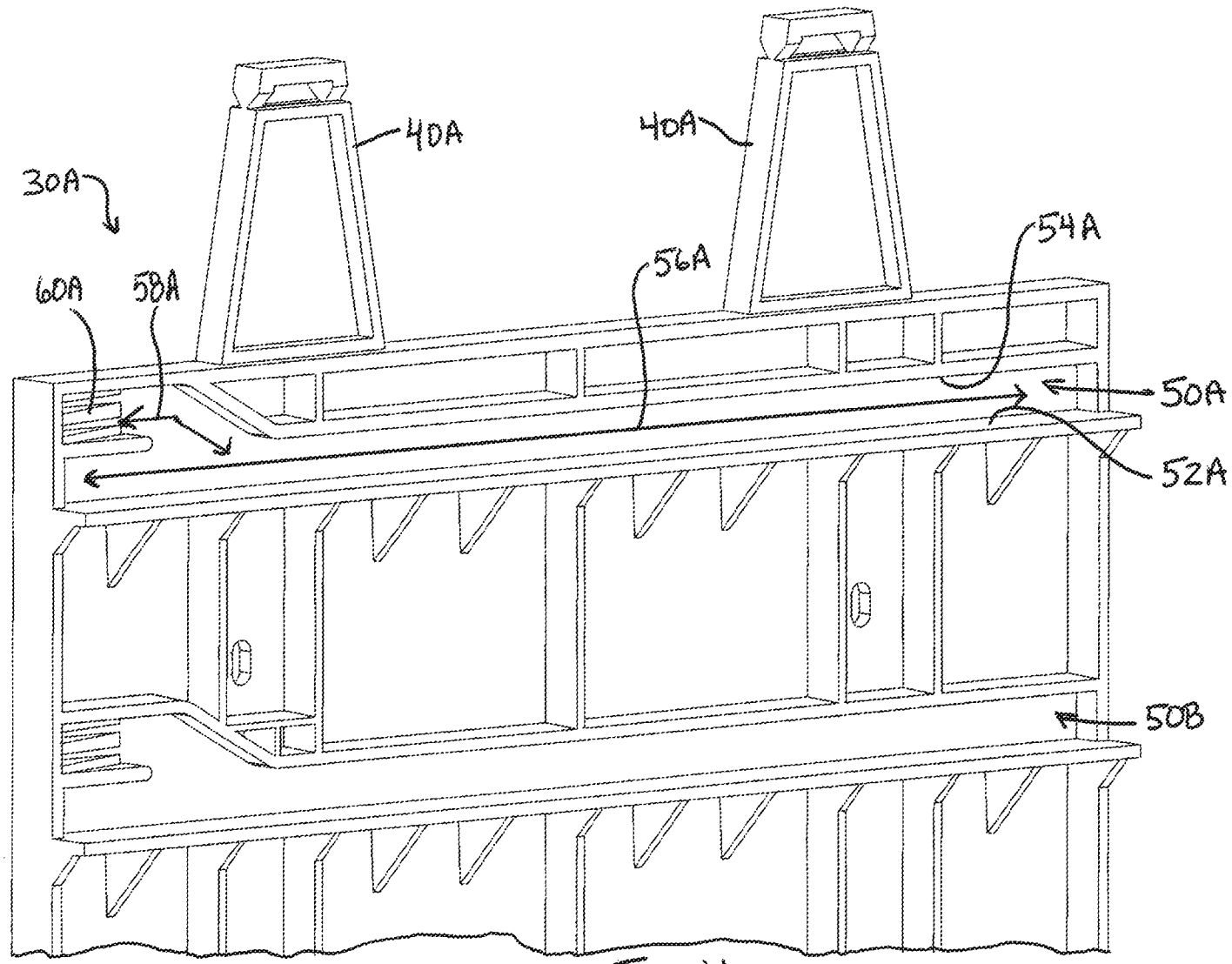
FIG. 11 shows a partial perspective of the left track insert.

Referring to FIGS. 9 and 10, where perspective and inner side elevation views of track insert 30A are shown, the track insert 30A includes plurality of tracks 50A-50E thereon (e.g., corresponding to the number of tray units that will be held). Here, as best seen in FIG. 11, each track is formed as a slot with a lower rail (e.g., 52A) and an upper rail (e.g., 54A), where the lower rail 52A extends inwardly relative to the interior space of the cabinet further than the upper rail 54A for tray support as will be described in greater detail below. Each track includes a primary path (e.g., 56A) that is substantially horizontal and the extends substantially the entire front to back dimension of the track insert (where the terms front and back are used relative to the orientation of the housing in which the track insert is placed). The primary path 56A enables movement of the loaded tray unit between its closed position and its extended position. Each track also includes a raised removal path (e.g., 58A) that intersects the primary path toward a forward end of the primary path. The raised removal path includes an inwardly projecting slide ramp (e.g., 60A) that facilitates removal of the tray unit from the housing as will be described in further detail below. The track insert 30B has its tracks oriented in a mirror image of those of the track insert 30A so that the tracks of the two inserts will oppose each other in an aligned manner when the inserts are positioned within the housing.

Figure 12:
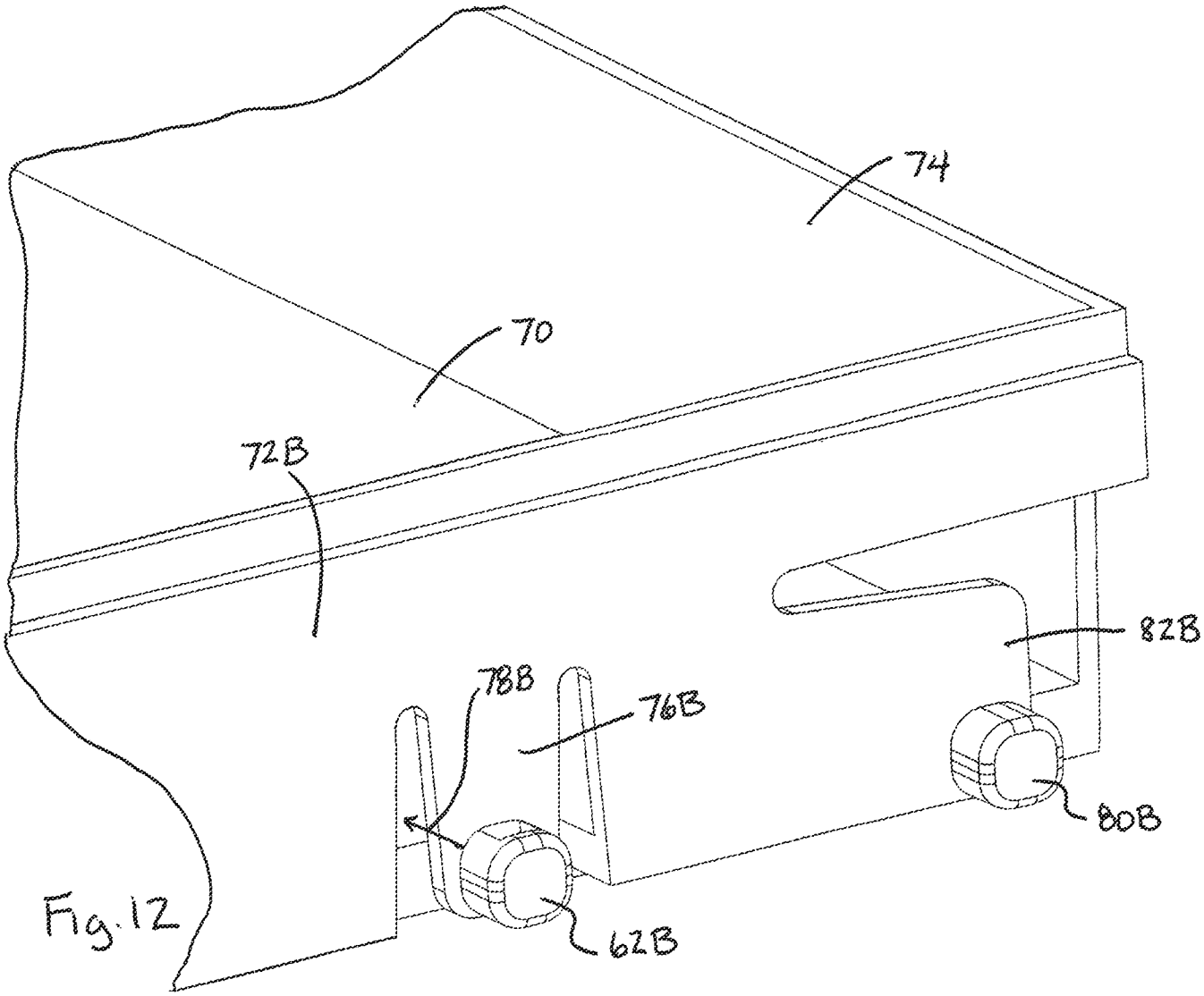
FIGS. 12 and 13 show partial perspectives a corner portion of a lower tray component.
Figure 13:
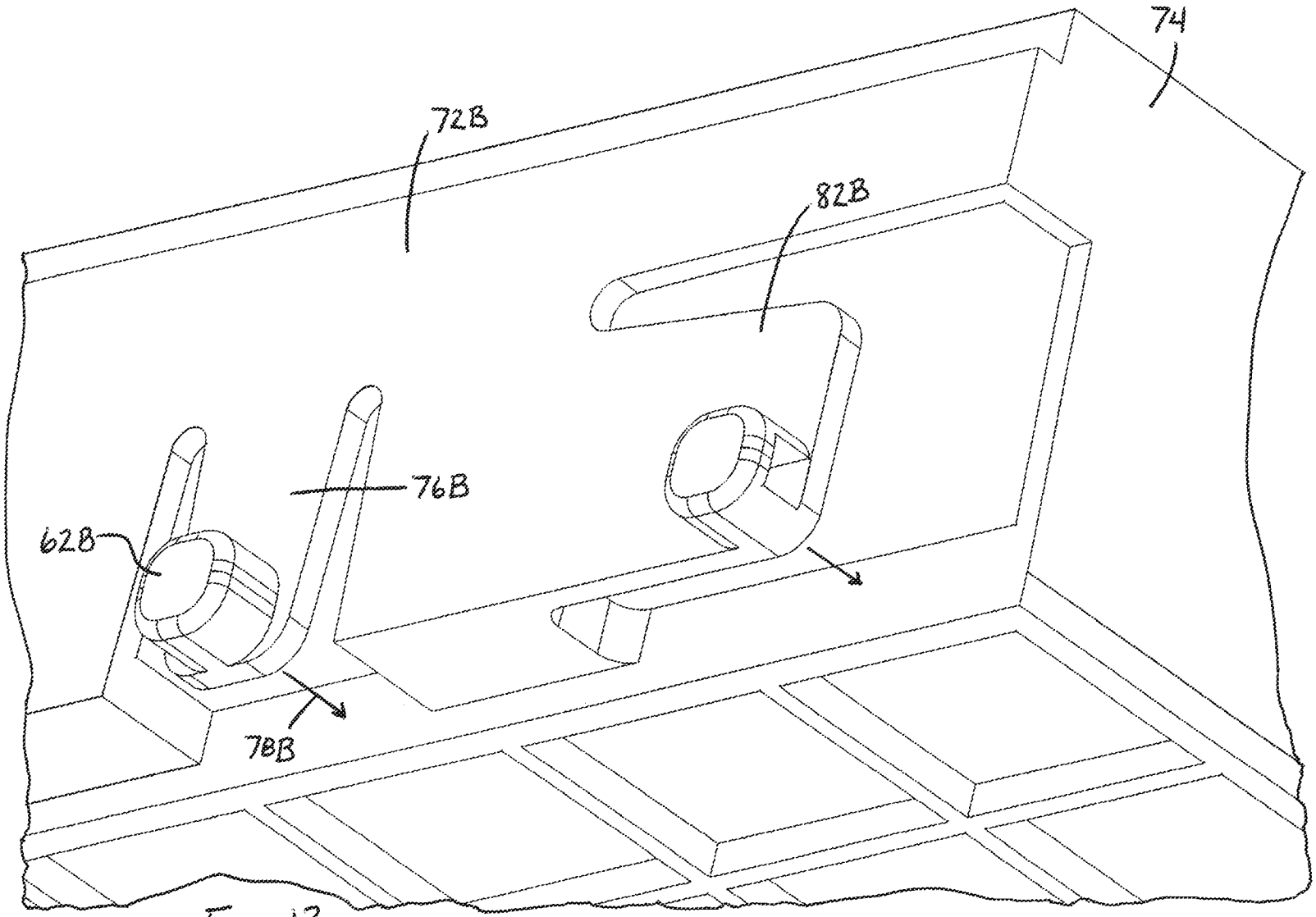

The lower tray component of each tray unit includes a left side engaged with a track in track insert 30A and a right side engaged with a corresponding and opposed track in the track insert 30B. In this regard, reference is made to FIGS. 12 and 13 showing partial perspective views of the right rear corner region of lower tray component 22, with an outwardly projecting slide 62B that rides within the track. Slide 62B also acts as a stop that contacts the wall at the forward end of the track when the tray assembly is in its extended position to limit forward movement of the lower tray component relative to the housing.

Referring again to FIG. 4 and FIGS. 12-13, the lower tray component 22 includes a tray base 70 (for supporting the upper tray component), an upwardly extending left sidewall 72A, an upwardly extending right sidewall 72B and an upwardly extending rear wall 74. The outwardly projecting slide 62B is located on a tab portion 76B of the sidewall 72B, where the tab portion 76B is capable of flexing inward (per arrow 78B) to facilitate installation and removal of the tray unit from the housing. The left sidewall 72A includes a similar tab portion 76A with an outwardly projecting slide 62A (shown in dashed line in FIG. 4). The right side of lower tray component includes an outwardly projecting slide 80B located on another flexible tab portion 82B of the right sidewall 72B, where tab portion 82B and slide 80B are located rearwardly of the slide 62B. Slide 62B also rides within the track and provides added stability, and may also act as a stop that contacts the wall at the rearward end of the track when the tray assembly is in its closed position. Left sidewall 72A includes a similar tab portion 82A and slide 80A (shown in dashed line form in FIG. 4).

Figure 14:
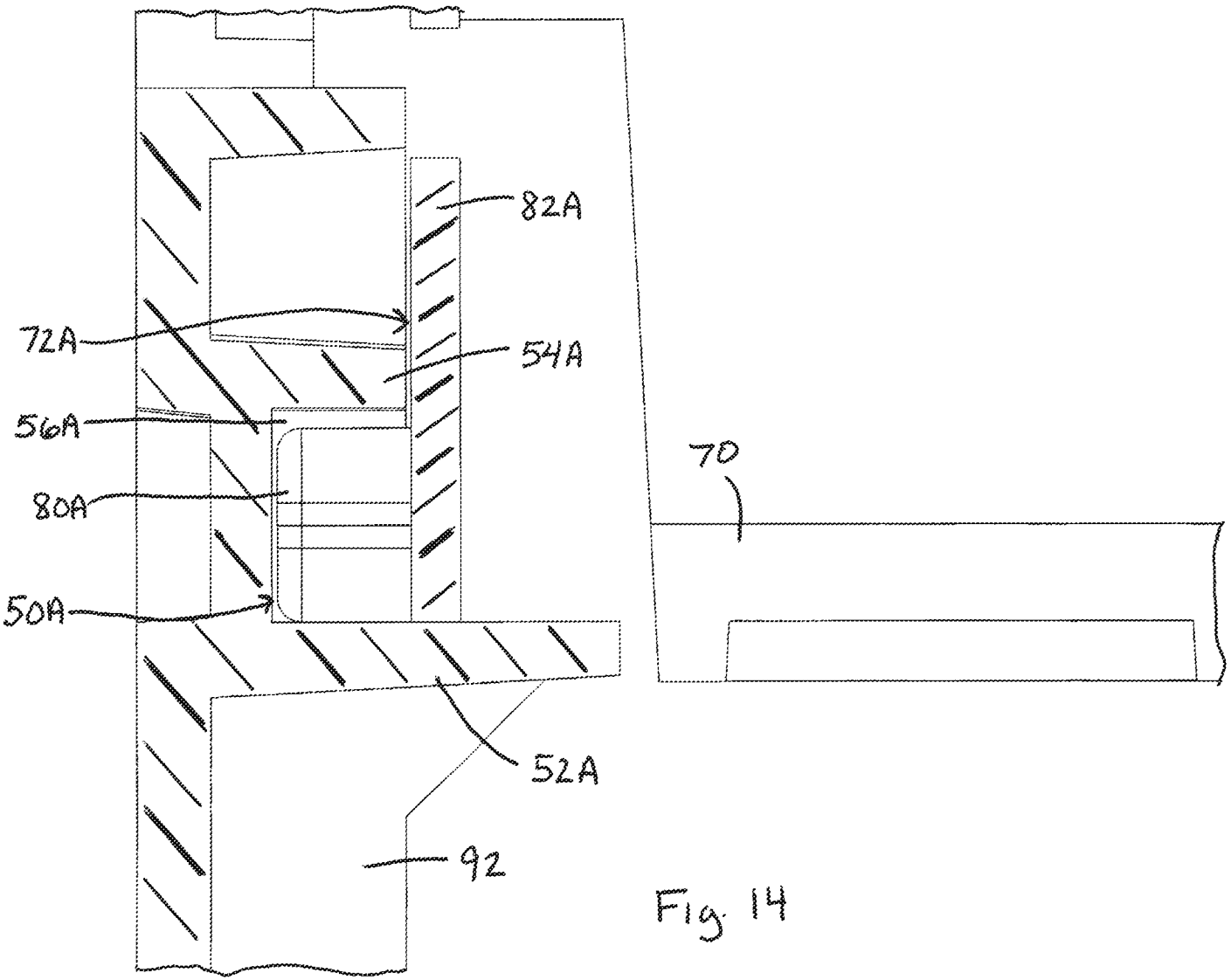
FIG. 14 shows a partial cross-section of a tray unit slide within a track.
Figure 15:
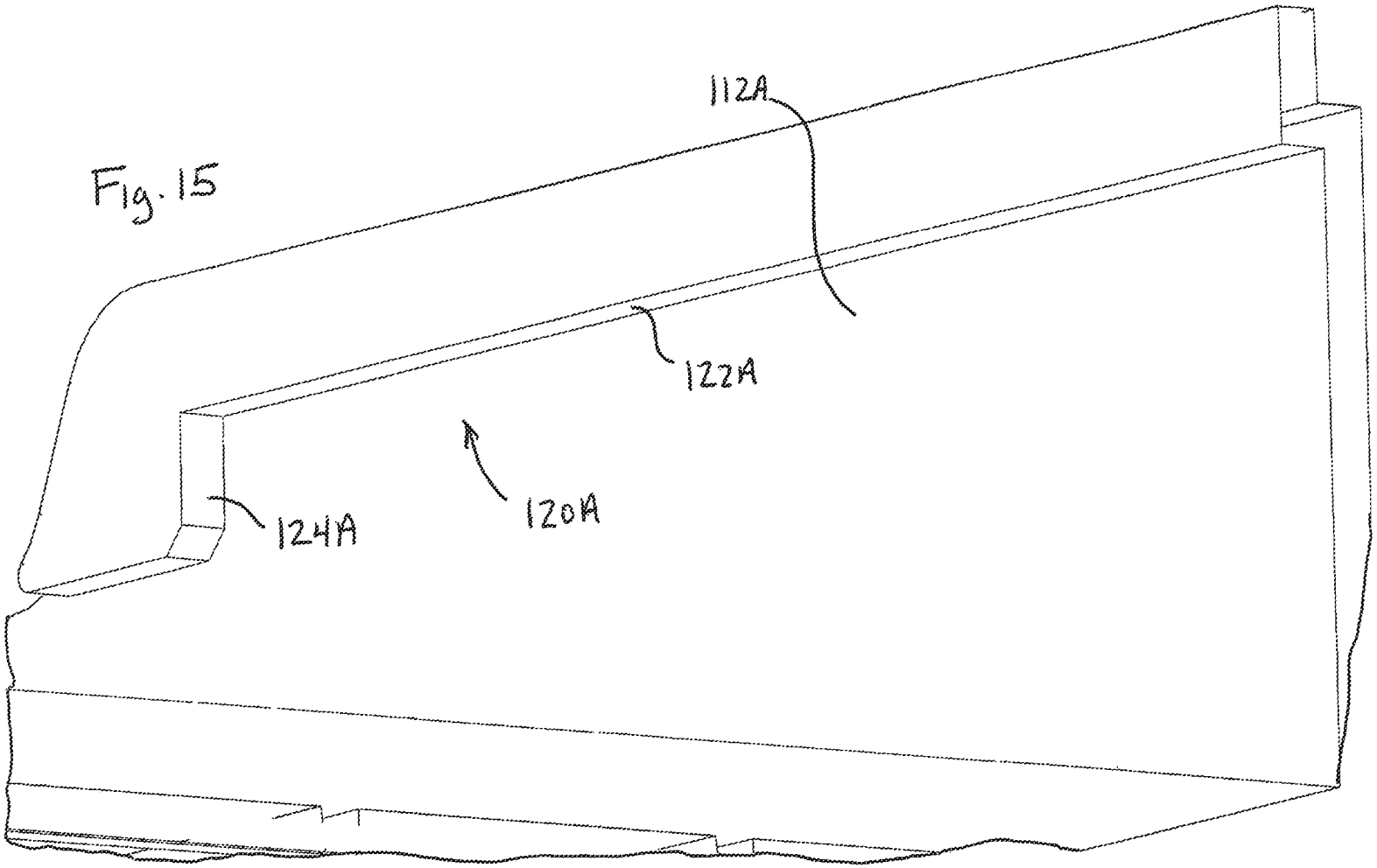
FIG. 15 shows a partial perspective of a corner portion of the lower tray component.
Figure 16:
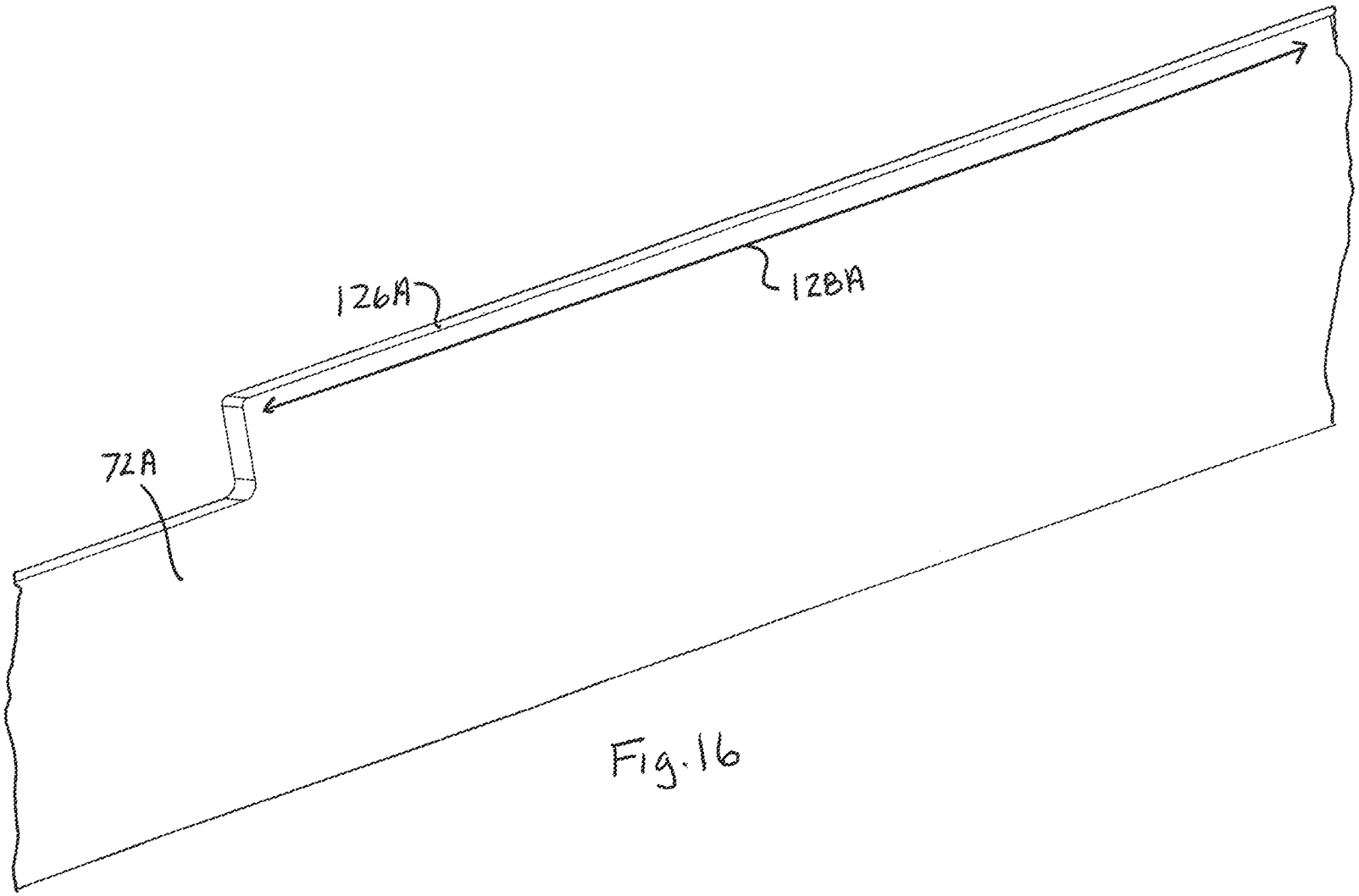
FIG. 16 shows a partial perspective of a corner portion of the upper tray component.

Referring to the partial cross-section of FIG. 14, track 50A is shown with slide 80A riding in the primary track portion 56A. As shown, lower rail 52A extends below and supports the left sidewall 72A (along substantially the entire front to rear extend of the sidewall) for additional support. The rail 52A may be supported by a plurality of ribs 90 and 92 as seen in FIGS. 9 and 10, where ribs 92 extending from the rail 52A down to the upper rail of the next track.

As noted above, the raised removal path of each track includes a ramp feature (e.g., 60A at the forward end). In order to remove the tray assembly from the housing, a user simply tilts the tray assembly up when the forward slides 62A and 62B are aligned with the intersection point of the raised path and the primary path and continues to pull so that the slides move up along the path. When the slides 62A, 62B engage the respective ramp features of their respective tracks, the tab portions 76A, 76B are urged so as to flex inward, along the slides 62A, 62B to clear the front portion of the tracks as well as the side frame segments of the housing opening. The rear slides 80, and 80B are moved along the same path for similar inward flexing, and the tray assembly can be completely removed from the housing. To install a tray assembly, a user manually pushes the tab portions inward during to clear the housing side frame segments and enter the track.

As mentioned above, the upper tray component 20 sits within the lower tray component 22 in a nested manner that permits a relative telescoping movement. In this regard, and referring to FIGS. 4, 5, 15 and 16, the upper tray component 20 includes a tray base 110 (for supporting the fastener bins), an upwardly extending left sidewall 112A, an upwardly extending right sidewall 112B and an upwardly extending rear wall 114. The left sidewall 112A of the upper tray component sits internally of the left sidewall 72A of the lower tray component, and the right sidewall 112B of the upper tray component sits internally of the right sidewall 72B of the lower tray component. Each sidewall 72A, 72B includes a rail (e.g., rail 120A) extending inwardly, where the rail includes a substantially horizontal support portion (e.g., 122A) and downwardly extending stop portion (e.g., 124A). Each sidewall of the upper tray component includes a rearward slide (e.g., 126A, 126B) that sits below the substantially horizontal support portion of its respective rail and rearwardly of the downwardly extending stop portion of its respective rail to help retain the upper tray component 20 within the lower tray component 22. In the illustrated embodiment, the rearward slides are formed by an elevated upper edge extent (e.g., 128A) of the sidewalls of the upper tray component. Notably, the front to back dimension of the extents 128A and 128B is less than one-half of the front to back dimension of the respective rails 120A, which enables the upper tray component to slide forward within the lower tray component (e.g., until the front of extent 128A hits the stop portion 124A of the rail) for the telescoping movement.

The lateral dimension between the outer surfaces of sidewalls 112A and 112B may substantially match the lateral dimension between the inner surfaces of sidewalls 72A and 72B (below the rails) so that the outer surfaces of walls 112A and 112B lie in adjacent contact with or in close proximity to the inner surfaces of sidewalls 72A and 72B. To engage the two tray components together the upper tray component is simply pressed down into the lower tray component (as suggested by the dashed line arrows in FIG. 4) and the sidewalls 72A, 72B and/or 112A, 112B will flex enough to allow the sidewalls to slide past the rails and once the upper edges of the sidewalls 112A and 112B move below the rails (e.g., 124A), the slides 126A and 126B move beneath the rails.

In the illustrated embodiment the rails (e.g., 120A) is formed by a laterally inward offset of the wall (e.g., while maintaining the same wall thickness). The upper tray component 20 may also include one or more upward projecting tabs 130A, 130B (FIG. 4) that are positioned to maintain a spacing between fastener bins loaded onto the tray. As seen in FIG. 13 the base 70 of the lower tray component (and similarly the base of the upper tray component) may include a grid or lattice beam structure for additional strength.

Figure 17:
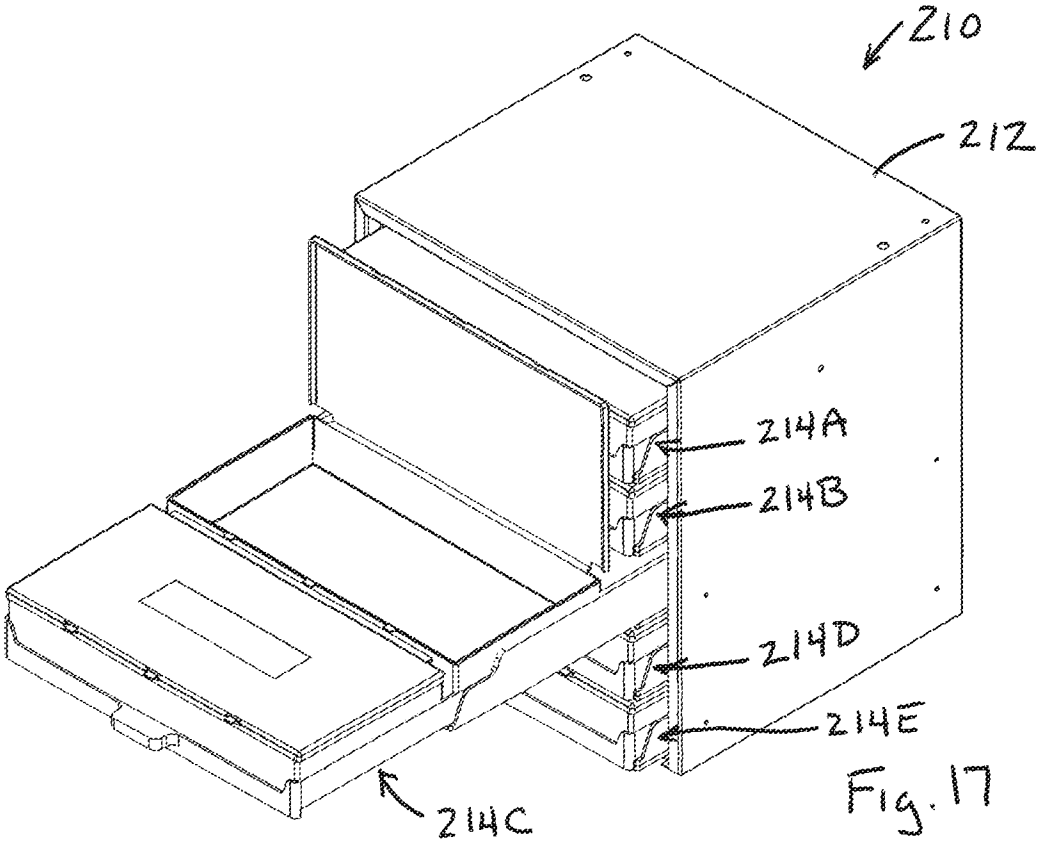
FIG. 17 shows another embodiment of a fastener cabinet.
Figure 18:
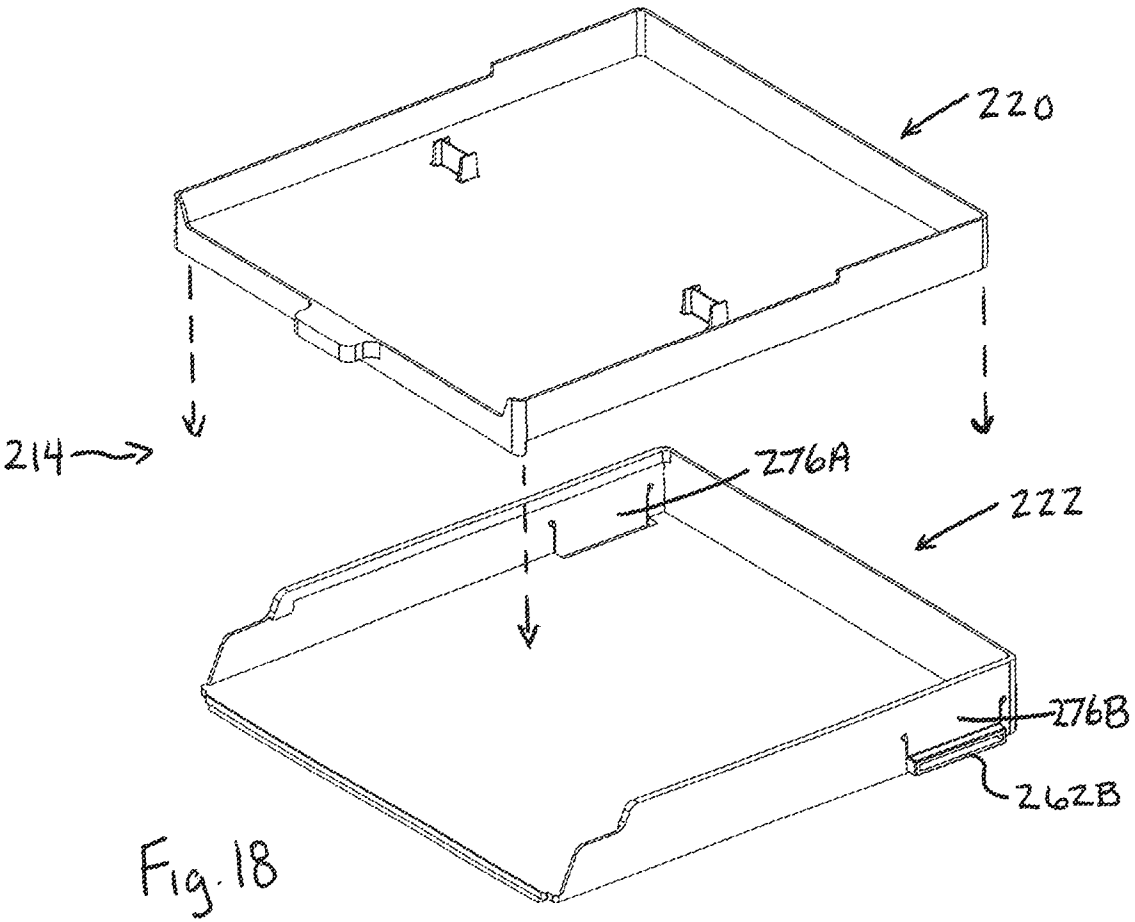
FIG. 18 shows an exploded view of another embodiment of a tray unit assembly.
Figure 19:
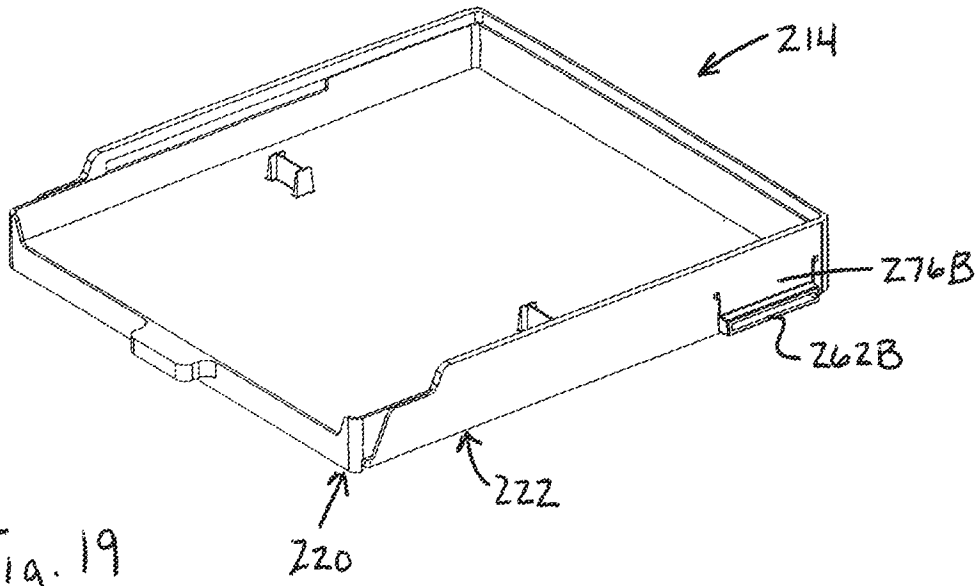
FIG. 19 shows the tray unit in assembled collapsed position.
Figure 20:
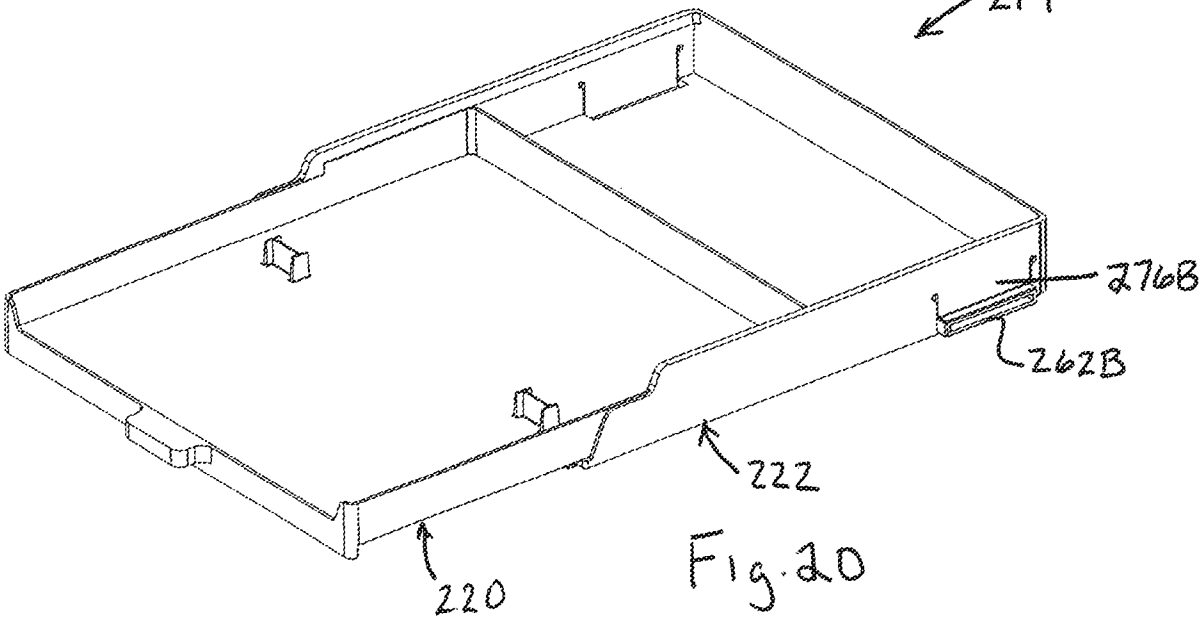
FIG. 20 shows the tray unit in assembled extended position.
Figure 21:
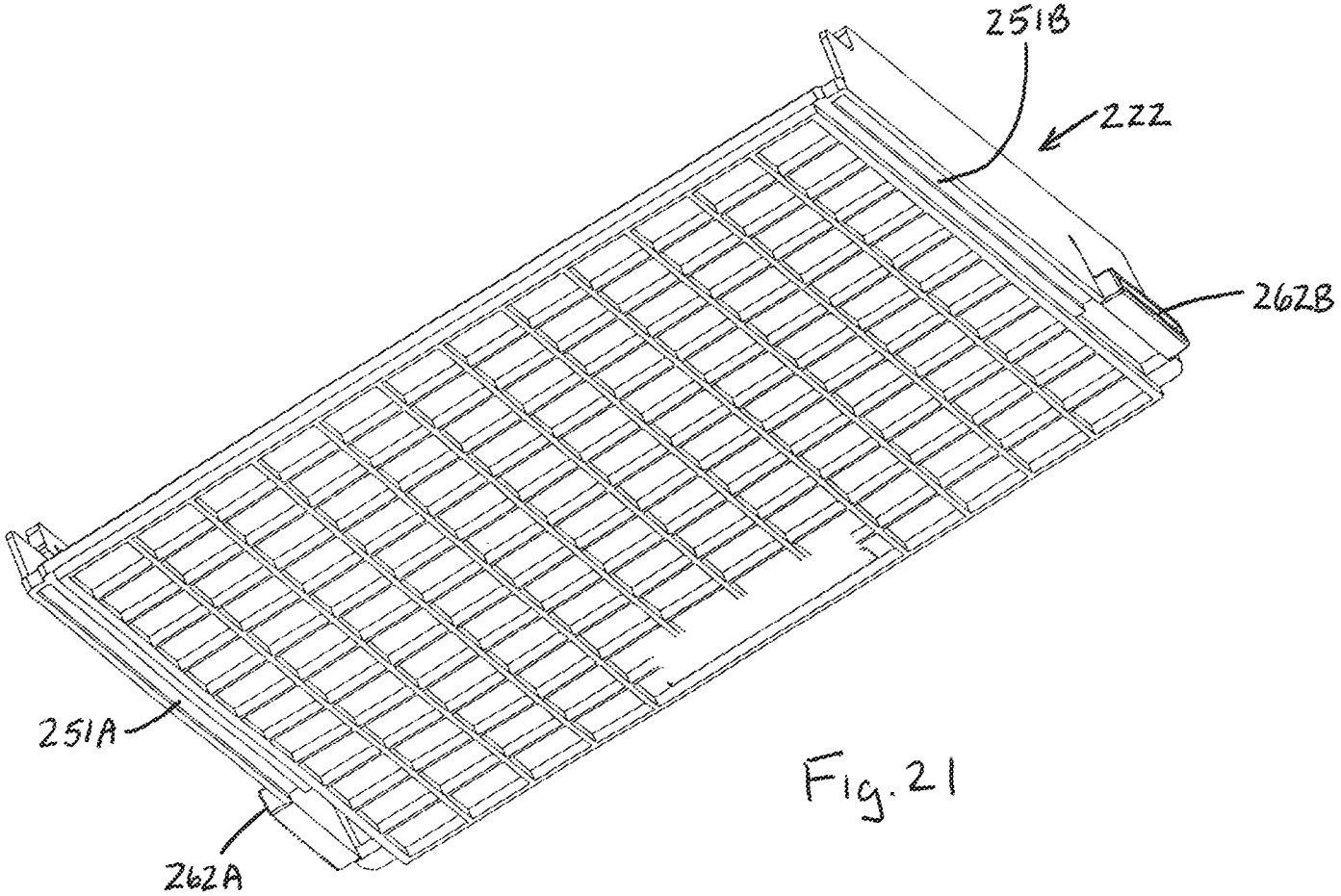
FIG. 21 shows a bottom perspective of the lower tray component.
Figure 22:
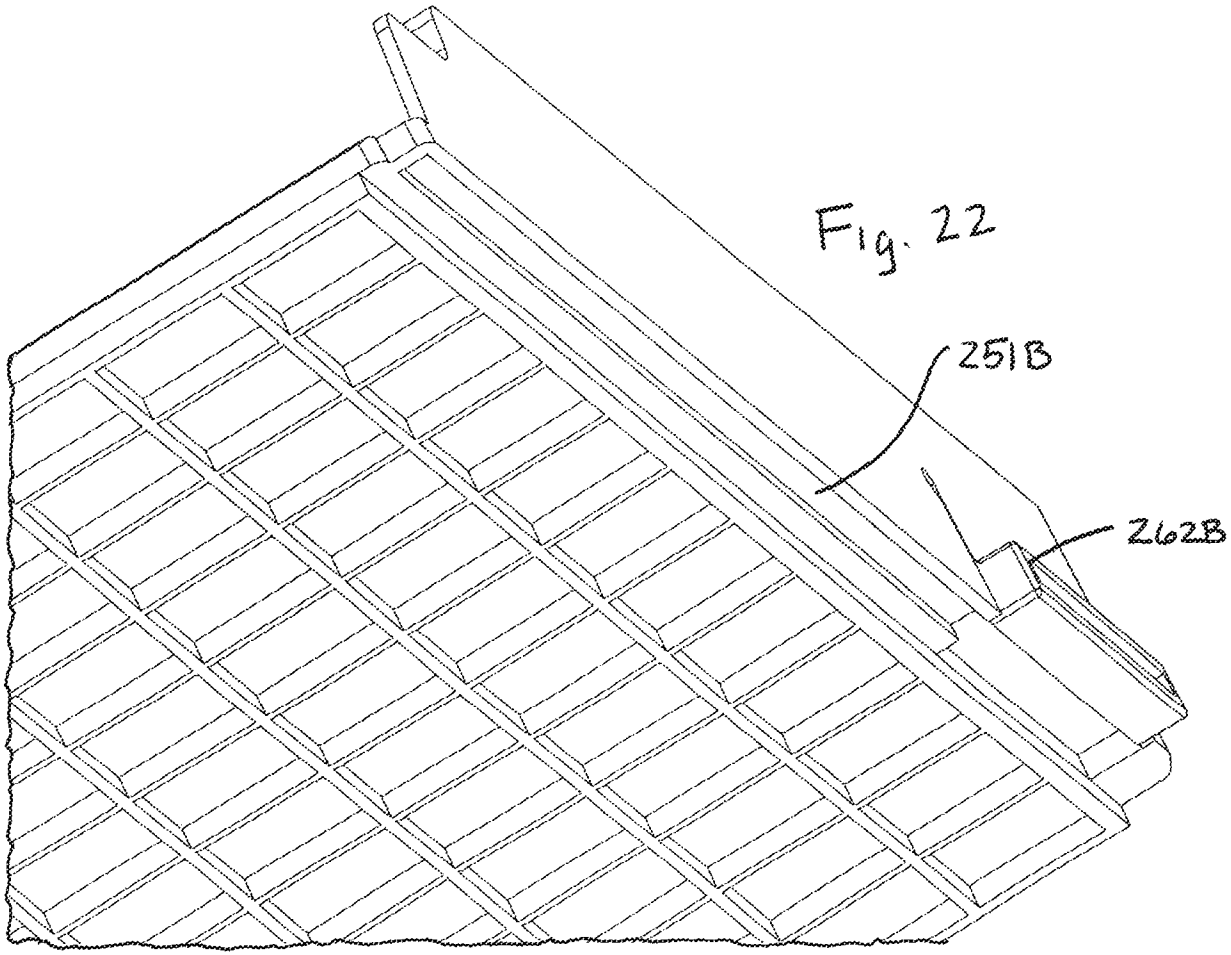
FIG. 22 shows a partial perspective of the bottom of the lower tray component.

Referring now to FIGS. 17-25 another embodiment of a fastener storage and display cabinet 210 is shown, utilizing a housing 212 with multiple tray units 214A-214E (where tray unit 214C is in its extended position in FIG. 17, and all other tray units are in closed positions). The tray units 214 are formed by upper and lower tray components 220 and 222, where the upper tray component 220 sits within the lower tray component 222 and is slidable relative to the lower tray component (between the relative positions of FIGS. 19 and 20) substantially the same as described above for tray component 14. Here, the lower tray component 222 includes a single, outwardly projecting and elongated slide on each side (e.g., slides 262A and 262B) and located on a flexing or flexible tab portion 276A or 276B of the tray sidewall. Guide slots 251A and 251B are also formed at the bottom sides of the lower tray component 222 for interaction with the cabinet tracks.

Figure 23:
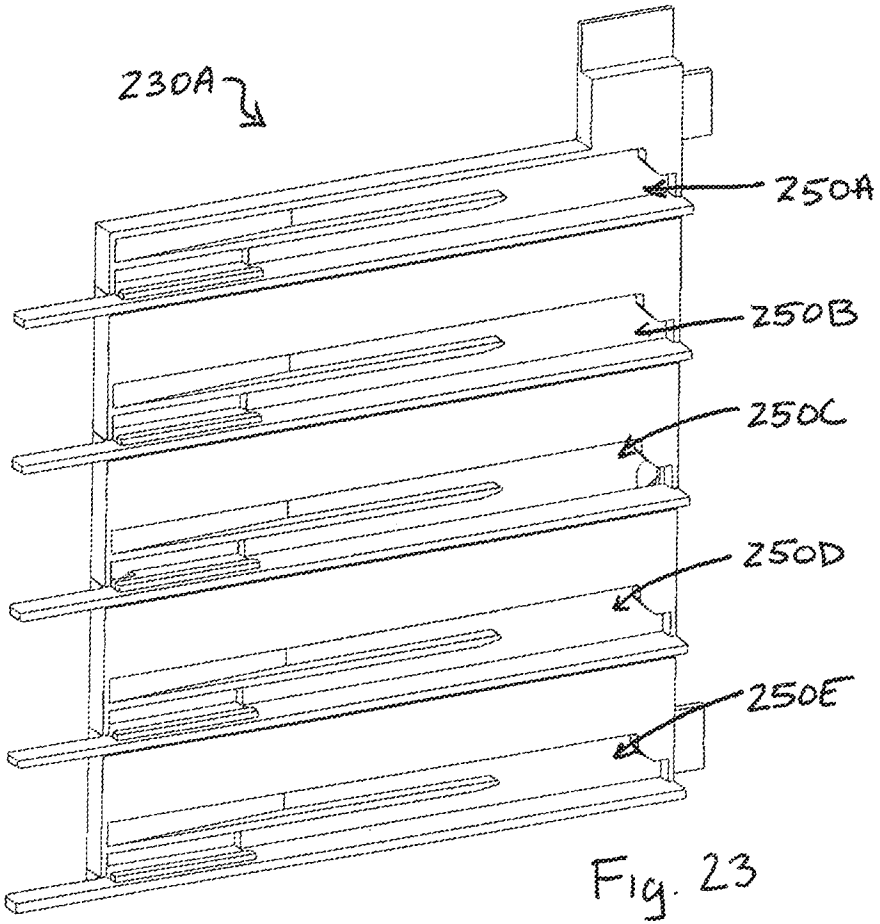
FIG. 23 shows a perspective of another embodiment of a left track insert.
Figure 24:
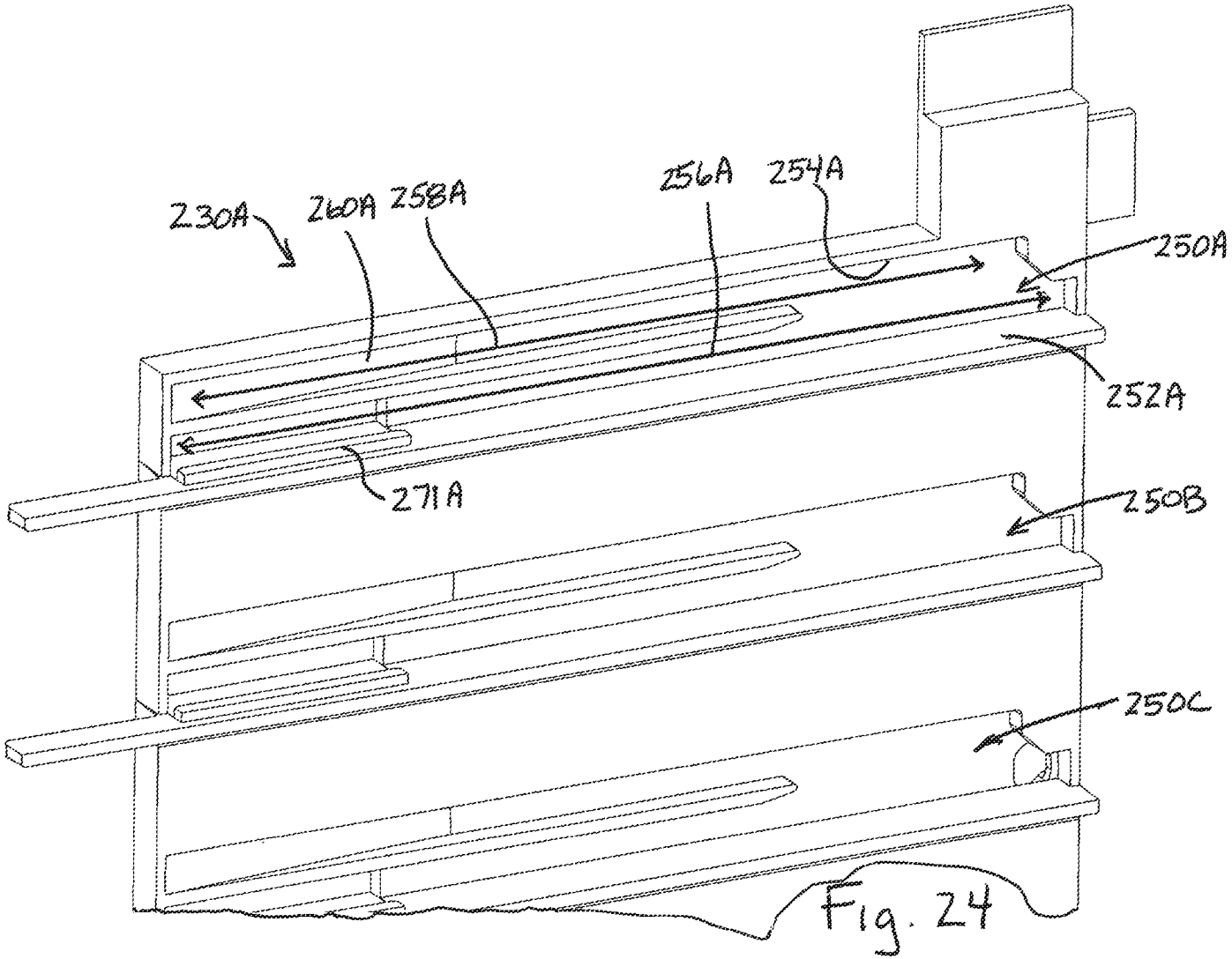
FIG. 24 shows a partial perspective of the left track insert.
Figure 25:
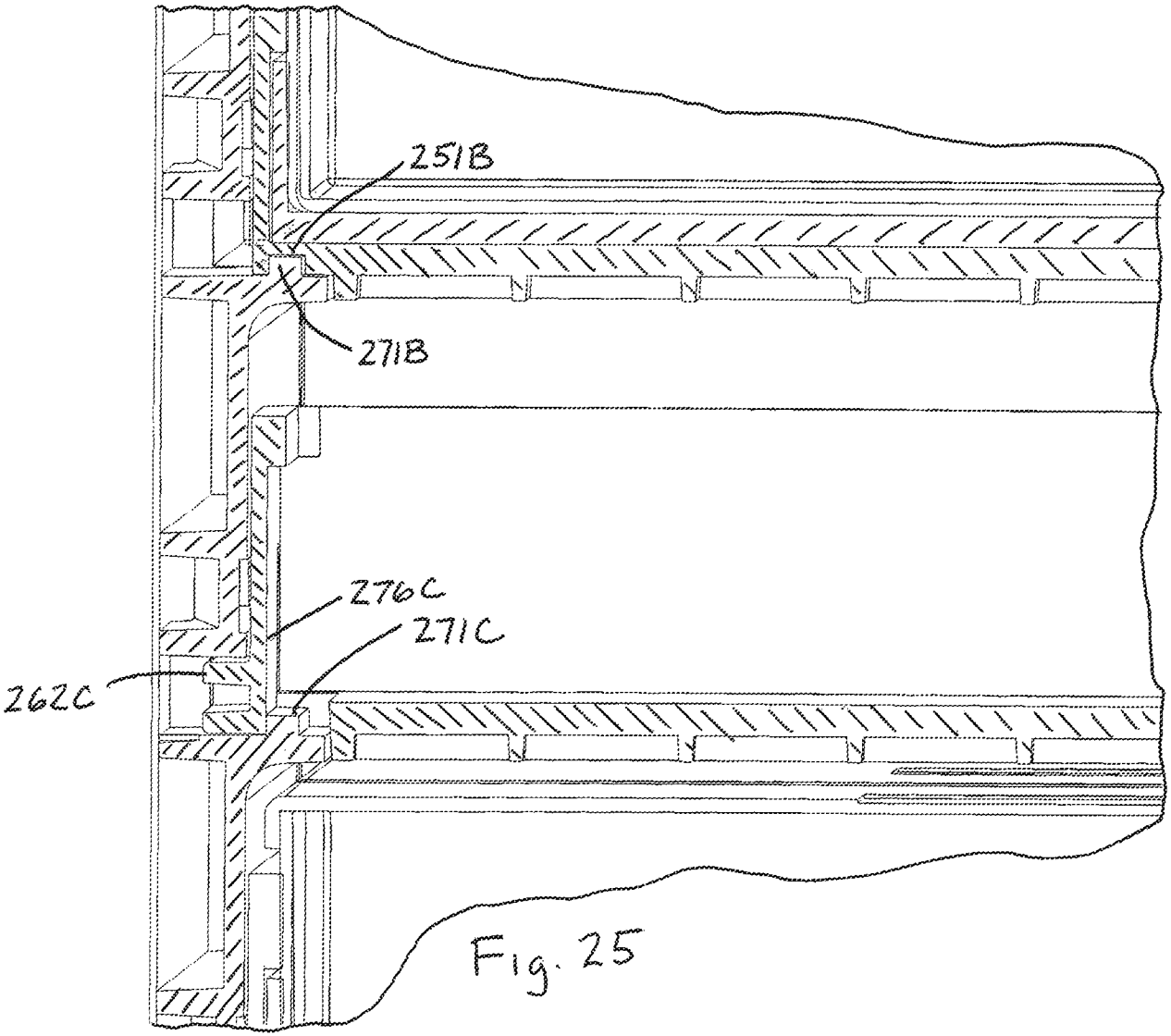
FIG. 25 shows a partial cross-section of tray units engaged with tracks.

Exemplary track insert 230A is shown in FIGS. 23 and 24, with multiple tracks 250A-250E, where each track is formed as a slot with a lower rail (e.g., 252A) and an upper rail (e.g., 254A), where the lower rail 252A extends inwardly relative to the interior space of the cabinet further than the upper rail 254A for tray support. Each track includes a primary path (e.g., 256A) that is substantially horizontal and the extends substantially the entire front to back dimension of the track insert (where the terms front and back are used relative to the orientation of the housing in which the track insert is placed). The primary path 256A enables movement of the loaded tray unit between its closed position and its extended position. Each track also includes a raised removal path (e.g., 258A) that intersects the primary path toward a rear end of the primary path. The raised removal path is substantially parallel to primary path 256A and includes an inwardly projecting slide ramp (e.g., 260A) at the forward end that facilitates removal of the tray unit from the housing (similar to ramp 60A described below). Notably, an elongated retaining protrusion (e.g., 271A) is located at the front of each track and extends upward from the lower rail 252A of the track and is configured to interact with both the guide slot 251A and slide 262A of the lower tray component. In particular, as seen in FIG. 25, retaining protrusion 271B is shown riding within guide slot 251B (for a tray unit that is in its closed position) and retaining protrusion 271C is shown located at the inner side of slide 262C and tab portion 276C (for a tray unit that is in its extended position). Thus, the retaining protrusions serve to prevent the flexible tab portions of the lower tray components from prying or twisting out of the tracks when the tray unit is in a fully extended and heavily loaded condition (e.g., under high cantilever loads).

To remove a tray unit from the cabinet 210, the tray unit is tilted upward while the lower tray component is in the fully rearward position so that the slides (e.g., 262A) will move up into the removal paths (e.g., 258A) of the tracks when the lower tray component is pulled forward. The slides (e.g., 262A) will interact with the track ramps (e.g., 260A) to cause the tab portions (e.g., 276A) to flex inward allowing the tray unit to be fully removed from the cabinet.

It is to be clearly understood that the above description is intended by way of illustration and example only, is not intended to be taken by way of limitation, and that other changes and modifications are possible.

What is claimed is:

1. A fastener storage and display cabinet, comprising:

a housing defining an internal space;

a plurality of tray units positioned within the internal space, each tray unit movable between a closed position primarily within the internal space and an extended position in which a majority of the tray unit is cantilevered forward of the housing;

wherein at least one tray unit is formed as a telescoping tray assembly comprising an upper tray component and a lower tray component, wherein the upper tray component fits within the lower tray component and is movable with respect to the lower tray component between a first position nested within the lower tray component and a second position cantilevered forwardly from the lower tray component in a substantially horizontal position;

wherein the lower tray component includes a left side having a left tab portion with an outwardly projecting left slide and a right side having a right tab portion with an outwardly projecting right slide, wherein both the left tab portion and the right tab portion are capable of flexing inward toward each other to enable removal of the tray assembly, including the lower tray component and the upper tray component, from the housing;

wherein the left slide rides within a left track within the housing and the right slide rides within a right track within the housing, wherein the left track includes a left retaining protrusion that aligns with the left tab portion when the one tray unit is in its extended position to limit inward flexing of the left tab portion under cantilever loads, and the right track includes a right retaining protrusion that aligns with the right tab portion when the one tray unit is in its extended position to limit inward flexing of the right tab portion under cantilever loads;

wherein the lower tray component includes a bottom side with a downwardly facing left guide slot and a downwardly facing right guide slot, the left retaining protrusion is stationary and the left guide slot rides over and along the left retaining protrusion and the right retaining protrusion is stationary and the right guide slot rides over and along the right retaining protrusion.

2. A fastener storage and display cabinet, comprising:

a housing defining an internal space;

a plurality of tray units positioned within the internal space, each tray unit movable between a closed position primarily within the internal space and an extended position in which a majority of the tray unit is cantilevered forward of the housing;

wherein at least one tray unit is formed as a telescoping tray assembly comprising an upper tray component and a lower tray component, wherein the upper tray component fits within the lower tray component and is movable with respect to the lower tray component between a first position nested within the lower tray component and a second position cantilevered forwardly from the lower tray component in a substantially horizontal position;

wherein the lower tray component includes a left side having a left tab portion with an outwardly projecting left slide and a right side having a right tab portion with an outwardly projecting right slide, wherein both the left tab portion and the right tab portion are capable of flexing inward toward each other to enable removal of the tray assembly, including the lower tray component and the upper tray component, from the housing;

wherein the left slide rides within a left track within the housing and the right slide rides within a right track within the housing, wherein the left track includes a left retaining protrusion that aligns with the left tab portion when the one tray unit is in its extended position to limit inward flexing of the left tab portion under cantilever loads, and the right track includes a right retaining protrusion that aligns with the right tab portion when the one tray unit is in its extended position to limit inward flexing of the right tab portion under cantilever loads;

wherein the left slide contacts a forward end of the left track when the tray assembly is in its extended position and the right slide contacts a forward end of the right track when the tray assembly is in its extended position, to limit forward movement of the lower tray component relative to the housing.

3. A fastener storage and display cabinet, comprising:

a housing defining an internal space;

a plurality of tray units positioned within the internal space, each tray unit movable between a closed position primarily within the internal space and an extended position in which a majority of the tray unit is cantilevered forward of the housing;

wherein at least one tray unit is formed as a telescoping tray assembly comprising an upper tray component and a lower tray component, wherein the upper tray component fits within the lower tray component and is movable with respect to the lower tray component between a first position nested within the lower tray component and a second position cantilevered forwardly from the lower tray component in a substantially horizontal position;

wherein the lower tray component includes a left side having a left tab portion with an outwardly projecting left slide and a right side having a right tab portion with an outwardly projecting right slide, wherein both the left tab portion and the right tab portion are capable of flexing inward toward each other to enable removal of the tray assembly, including the lower tray component and the upper tray component, from the housing;

wherein the left slide rides within a left track within the housing and the right slide rides within a right track within the housing, wherein the left track includes a left retaining protrusion that aligns with the left tab portion when the one tray unit is in its extended position to limit inward flexing of the left tab portion under cantilever loads, and the right track includes a right retaining protrusion that aligns with the right tab portion when the one tray unit is in its extended position to limit inward flexing of the right tab portion under cantilever loads;

wherein the left track is formed on a left track insert positioned within the interior space on a left sidewall of the housing, and the right track is formed on a right track insert positioned within the interior space on a right sidewall of the housing.

4. The fastener storage and display cabinet of claim 3 wherein the left track insert includes a lower base portion abutting a bottom wall of the housing and an upper portion abutting a top wall of the housing to aid in retaining the left track insert in place within the housing, the right track insert includes a lower base portion abutting the bottom wall of the housing and an upper portion abutting the top wall of the housing to aid in retaining the right track insert in place within the housing.

5. The fastener storage and display cabinet of claim 3 wherein the housing includes a front opening through which the tray units move between the closed position and the extended position, the front opening includes left frame segment that aids in retaining the left track insert within the housing and a right frame segment that aids in retaining the right track insert within the housing.

6. A fastener storage and display cabinet, comprising:

a housing defining an internal space;

a plurality of tray units positioned within the internal space, each tray unit movable between a closed position primarily within the internal space and an extended position in which a majority of the tray unit is cantilevered forward of the housing;

wherein at least one tray unit is formed as a telescoping tray assembly comprising an upper tray component and a lower tray component, wherein the upper tray component fits within the lower tray component and is movable with respect to the lower tray component between a first position nested within the lower tray component and a second position cantilevered forwardly from the lower tray component in a substantially horizontal position;

wherein the lower tray component includes a left side having a left tab portion with an outwardly projecting left slide and a right side having a right tab portion with an outwardly projecting right slide, wherein both the left tab portion and the right tab portion are capable of flexing inward toward each other to enable removal of the tray assembly, including the lower tray component and the upper tray component, from the housing;

wherein the left slide rides within a left track within the housing and the right slide rides within a right track within the housing, wherein the left track includes a left retaining protrusion that aligns with the left tab portion when the one tray unit is in its extended position to limit inward flexing of the left tab portion under cantilever loads, and the right track includes a right retaining protrusion that aligns with the right tab portion when the one tray unit is in its extended position to limit inward flexing of the right tab portion under cantilever loads;

wherein the left track includes a lower left primary path for movement of the at least one tray unit between its closed position and its extended position, and a raised left removal path having an inner end intersecting the left primary path for enabling removal of the at least one tray unit from the housing, and the right track includes a lower right primary path for movement of the at least one tray unit between its closed position and its extended position, and a raised right removal path having an inner end intersecting the right primary path for enabling removal of the at least one tray unit from the housing.

7. The fastener storage and display cabinet of claim 6 wherein the raised left removal path includes a left inwardly projecting slide ramp and the raised right removal path includes a right inwardly projecting slide ramp.

8. A fastener storage and display cabinet, comprising:

a housing defining an internal space;

a plurality of tray units positioned within the internal space, each tray unit movable between a closed position primarily within the internal space and an extended position in which a majority of the tray unit is cantilevered forward of the housing;

wherein at least one tray unit is formed as a telescoping tray assembly comprising an upper tray component and a lower tray component, wherein the upper tray component fits within the lower tray component and is movable with respect to the lower tray component between a first position nested within the lower tray component and a second position cantilevered forwardly from the lower tray component in a substantially horizontal position;

wherein the lower tray component includes a left side having a left tab portion with an outwardly projecting left slide and a right side having a right tab portion with an outwardly projecting right slide, wherein both the left tab portion and the right tab portion are capable of flexing inward toward each other to enable removal of the tray assembly, including the lower tray component and the upper tray component, from the housing;

wherein the left slide rides within a left track within the housing and the right slide rides within a right track within the housing, wherein the left track includes a left retaining protrusion that aligns with the left tab portion when the one tray unit is in its extended position to limit inward flexing of the left tab portion under cantilever loads, and the right track includes a right retaining protrusion that aligns with the right tab portion when the one tray unit is in its extended position to limit inward flexing of the right tab portion under cantilever loads;

wherein the lower tray component includes a left sidewall and a right sidewall, the left sidewall includes a left rail extending inwardly, the left rail including a left substantially horizontal support portion and a left downwardly extending stop portion, the right sidewall includes a right rail extending inwardly, the right rail including a right substantially horizontal support portion and a right downwardly extending stop portion.

9. The fastener storage and display cabinet of claim 8 wherein the upper tray component includes a left sidewall upper edge portion and a right sidewall upper edge portion, the left sidewall upper edge portion sits beneath the left substantially horizontal support portion of the left rail and the right sidewall upper edge portion sits beneath the right substantially horizontal support portion of the right rail.

* * * * *